United States Patent [19]

Sjogren

[11] 3,951,218

[45] Apr. 20, 1976

[54] PERFORATING APPARATUS

[75] Inventor: Charles A. Sjogren, Houston, Tex.

[73] Assignee: Schlumberger Technology Corporation, New York, N.Y.

[22] Filed: Apr. 11, 1975

[21] Appl. No.: 567,457

[52] U.S. Cl. ..... 175/4.6; 102/24 HC

[51] Int. Cl.[2] ..... E21B 43/117

[58] Field of Search ..... 175/4.6, 4.53; 102/20, 102/24 HC

[56] References Cited

UNITED STATES PATENTS

| | | | |
|---|---|---|---|
| 2,782,715 | 2/1957 | Udry | 175/4.6 |
| 2,844,098 | 7/1958 | Castel | 175/4.6 |
| 2,925,775 | 2/1960 | McKee | 175/4.6 X |
| 3,075,462 | 1/1963 | Adamson, Jr. | 175/4.6 X |
| 3,282,354 | 11/1966 | Hakala et al. | 175/4.6 |
| 3,773,119 | 11/1973 | Shore | 175/4.6 |
| R28,061 | 7/1974 | Shore | 175/4.6 |

*Primary Examiner*—Stephen J. Novosad
*Attorney, Agent, or Firm*—William R. Sherman; Ernest R. Archambeau, Jr.; Stewart F. Moore

[57] ABSTRACT

In the representative embodiment of the present invention disclosed herein, shaped charges adapted for installation in a typical end-loaded carrier are respectively provided with a domed annular retainer member of a thin, but substantially rigid and stiff, material which is coaxially disposed over the forward end of each charge. A smaller-diameter externally-tapered sleeve of a somewhat yieldable or deformable material is cooperatively arranged for positioning on each domed retainer member once its associated shaped charge is installed in the carrier facing and aligned with a lateral port therein. Then, as a port plug having an internally-tapered recess is installed in the port and telescopically forced over the sleeve, the forward portion of the retainer sleeve will be laterally compressed for securing the shaped charge in position with little or no inward or axial deflection of the domed retainer.

12 Claims, 6 Drawing Figures

PERFORATING APPARATUS

One of the more-typical oil field perforators in common usage today is comprised of an enclosed tubular body having one or more laterally-directed shaped explosive charges mounted at longitudinally-spaced intervals therein and operatively associated with electrically-responsive detonating means. As is common, the perforator body or so-called "carrier" is a heavy-walled steel cylinder designed to withstand the extreme explosive forces produced by the detonation of the explosives carried therein. To permit the carrier to be reused, each shaped charge is respectively faced toward a lateral port in the carrier body which is customarily covered by an expendable port-closure member such as a threaded plug which is fluidly sealed in the port. Those skilled in the art will recognize, moreover, that for a given carrier size, significantly larger shaped charges can be employed where the charges are inserted through one end of the carrier rather than being installed through the lateral ports in the carrier wall.

Many mounting arrangements have, of course, been proposed heretofore so that the shaped charges will be retained in alignment with their associated ports in such "end-loaded" carriers. For instance, one type of mounting arrangement employs a thick-walled elastomeric sleeve which is yieldably compressed between the forward end of a shaped charge and either the internal wall of lateral port (as shown in U.S. Pat. No. 2,707,917) or the inward end of a typical threaded port plug (as shown in U.S. pat. No. 2,782,715). Although such elastomeric sleeves are well suited for accommodating dimensional variations and progressive swelling of the carrier, experience has shown, however, that these sleeves are wholly incapable of reliably retaining the shaped charges in position when the perforator is subjected to even moderate shocks or impacts. For example, it is not at all uncommon for the shaped charges to be completely dislodged by the impact caused by dropping the carrier for a distance of only three or four feet.

Selectively-adjustable alignment arrangements which are capable of withstanding such impacts are respectively shown in U.S. Pat. No. 2,680,406 and in Reissue U.S. Pat. No. 28,061. In each of these arrangements, once the charge is installed in a carrier, a rigid dome-shaped cover or alignment member of metal or the like is rotated in relation to the shaped charge case to an advanced position where the shaped charge is locked in place within the carrier. Although these two arrangements have the advantage of firmly securing the shaped charges in position, each involves some additional costs and also requires the time-consuming special manipulation of each alignment member as the gun is being assembled.

Another general charge-mounting technique is illustrated in U.S. Pat. No. 2,662,474, U.S. Pat. No. 3,075,462 and U.S. Pat. No. 3,282,354. As shown in each of those three patents, a short, rigid tube of a relatively-small diameter is coaxially positioned ahead of a larger deformable metal disc or dome-shaped alignment member that is disposed over the forward end of a shaped charge. In the first of the above-listed patents, the rigid tube is tightly secured within the lateral port of the carrier by a wedgelike tubular retainer, with the several parts being sized and arranged for sufficiently compressing or axially deflecting the dome-shaped alignment member inwardly for firmly biasing the charge into its operating position. In the other two patents, the short tube is positioned between the axially-deformable disc or domed retainer and the base of the port plug and is sized so that as the plug is tightened, the domed retainer is depressed sufficiently inwardly that it will resiliently, but firmly, urge the shaped charge into position.

This last-mentioned mounting arrangement is, of course, relatively inexpensive and involves no special or additional handling procedure for assembling a perforating gun. Experience has shown, however, that despite its overall desirability, this general type of mounting arrangement is difficult to implement where a given gun is intended to provide maximum performance as well as to be capable of operating as many times as is reasonably safe before the carrier finally becomes unusable. For instance, it is essential that the several parts be sized for achieving the amount of inward deflection of the alignment member required to develop the necessary biasing force for firmly securing a shaped charge in place. This means, of course, that the dimensions of these several parts must be such that duplicates of these parts can be used whether the carrier is new or has been successively enlarged by repeated usage. As a result, the usual practice heretofore has been to simply size the several expendable parts for functioning under the worst situation (i.e., when the carrier is swelled to its maximum-permissible dimension). In this situation, the dome-like alignment member must still be deflected inwardly a sufficient distance as the port plug is tightened to assure the development of an adequate biasing force for holding the charge in place. Thus, with this worst-case situation dictating the dimensions of the several alignment components, it is recognized that when such components are used in conjunction with a new, unswollen carrier, the domed retainer will necessarily be deflected still further inwardly.

It should be noted, however, that since the liner materials forming the trailing portion of the axially-directed perforating jet will move inwardly along a path which is substantially perpendicular to the forward part or base of the liner before it collapses, the internal diameter of the annular retainer and the longitudinal spacing between the retainer and the base of the charge liner can become rather critical. This is particularly significant where the shaped charge is to be as large as possible and is installed in a carrier of proportionally limited size. Therefore, if the performance of a perforating gun with such close spacing is to be maximized, the several components of such charge-mounting arrangements must be carefully sized to be certain that tightening of the port plug will not deflect the domed retainer inwardly into the intended path of the perforating jet.

A greater deflection of a domed retainer such as those shown in the three last-mentioned patents ordinarily presents no problem so long as the operation of the shaped charge is not impaired. For example, with a perforator arranged as shown in U.S. Pat. No. 2,662,474, the axial clearance between the forward end of the shaped charge liner and the domed retainer is so great that there is little or no possibility that the inwardly-deflected retainer could ever interfere with the proper formation of the perforating jet. On the other hand, in an arrangement with such closely-spaced dimensions as depicted in U.S. Pat. No. 3,282,354, it will be recognized by those skilled in the art that any further inward or axial deflection of the domed alignment member beyond its illustrated position will significantly impair the formation of the perforating jet.

Accordingly, it is an object of the present invention to provide new and improved perforating apparatus having one or more shaped explosive charges which are firmly secured in an enclosed carrier in precise alignment with their respectively-associated port-closure members. In particular, it is an object of the present invention to provide an inexpensive, but reliable, arrangement for securing such shaped charges in an end-loaded carrier without impairing the operating performance of the shaped charges.

This and other objects of the present invention are attained by providing an annular, substantially-rigid dome-shaped alignment member arranged for placement over the forward end of a typical shaped explosive charge installed in an enclosed tubular carrier and facing a lateral port in the wall of the carrier. To avoid significant inward or axial deflection of the domed member regardless of reasonable variations in the diameter of the carrier, a short, and therefore axially stiffened, tubular retainer member is cooperatively arranged so that its forward end will be received within a converging bore or recess formed in the base of threaded port plug as it is being installed. Thereafter, as the port plug is further tightened, the nose of the tubular retainer will be correspondingly compressed inwardly for imposing only a moderate axially-directed securing force on the shaped charge which is of sufficient magnitude to reliably secure it within the carrier but without causing axial deflection of the domed retainer of such magnitude as to impair the performance of the shaped charge when it is ultimately detonated.

The novel features of the present invention are set forth with particularity in the appended claims.

The invention, together with further objects and advantages thereof, may be best understood by way of the following description of exemplary apparatus employing the principles of the invention as illustrated in the accompanying drawings, in which.

Figure 2:
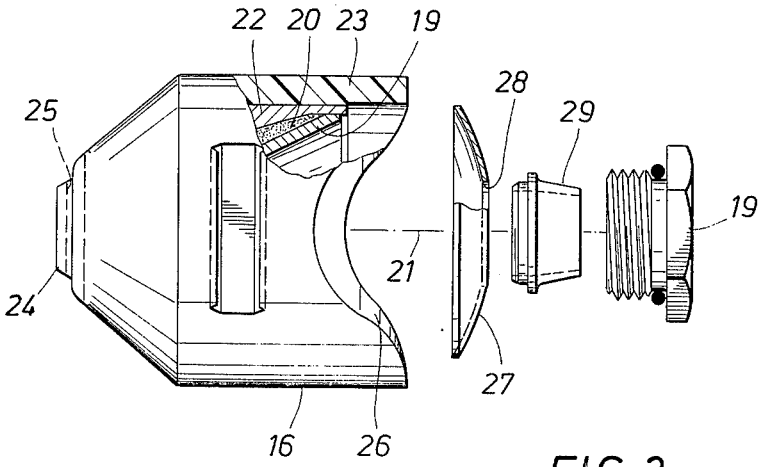
FIG. 2 depicts a preferred embodiment of the new and improved apparatus of the present invention.
Figure 3:
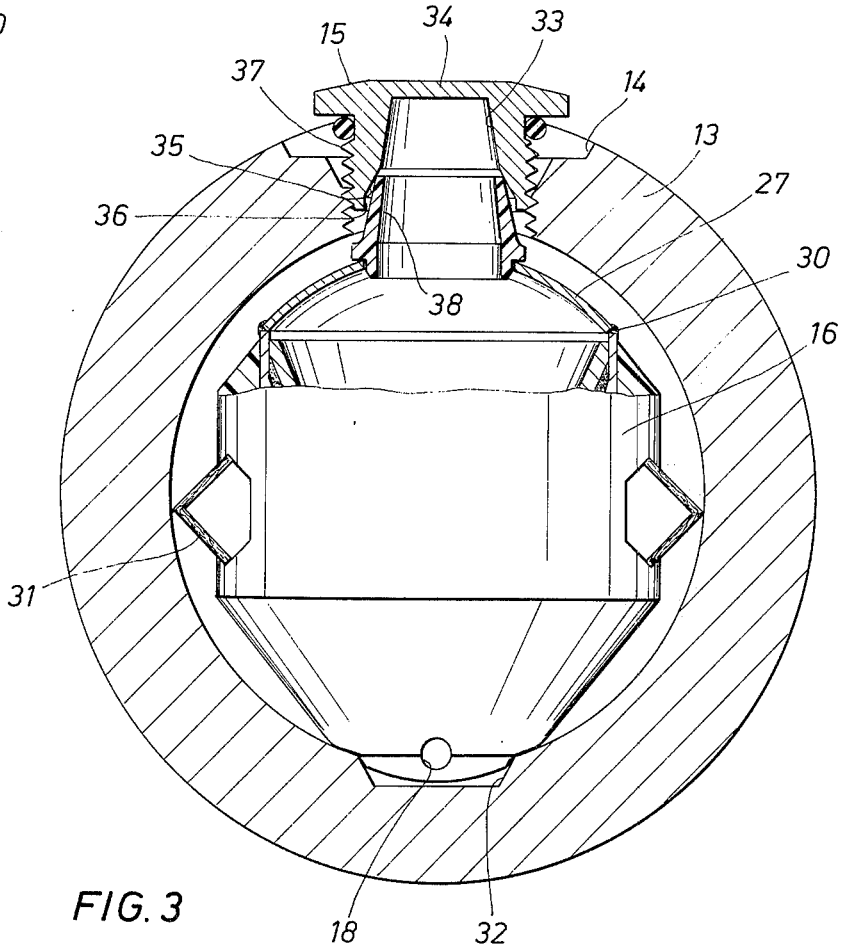
Figure 4:
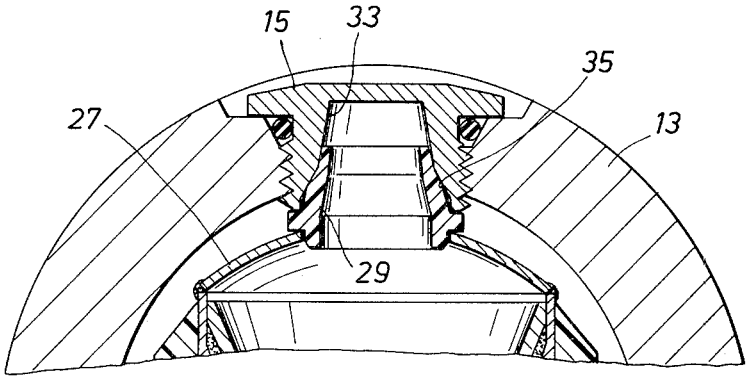
Figure 5:
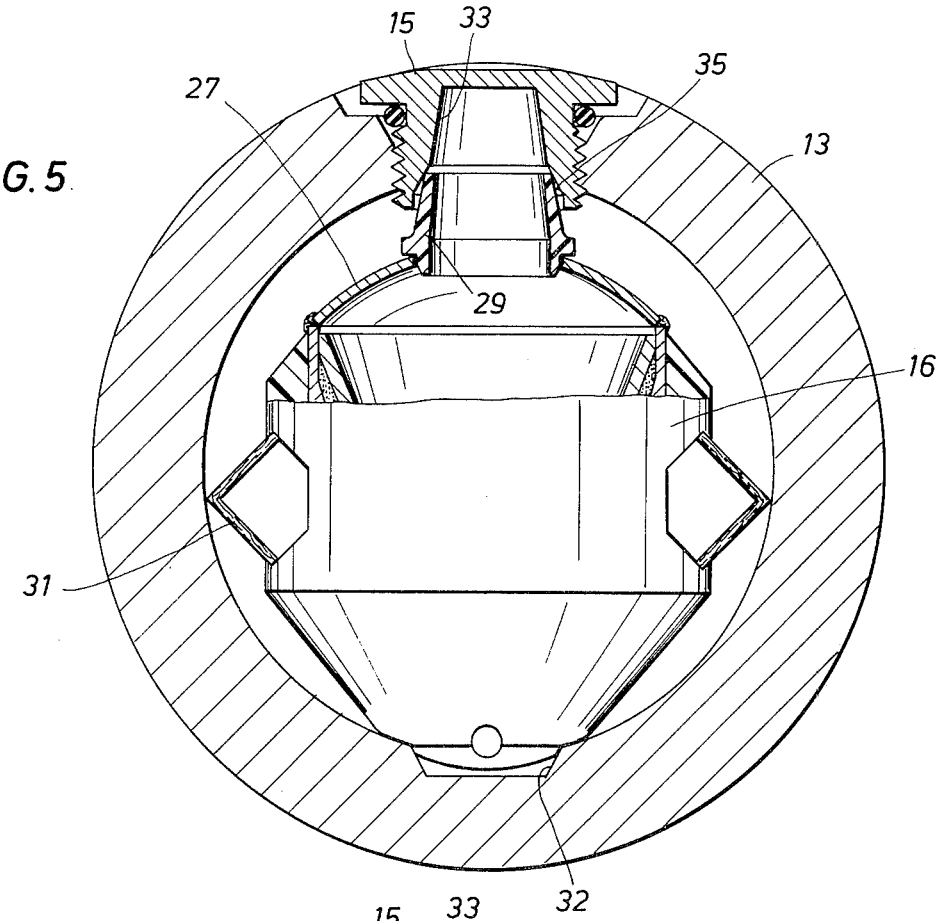
Figure 6:
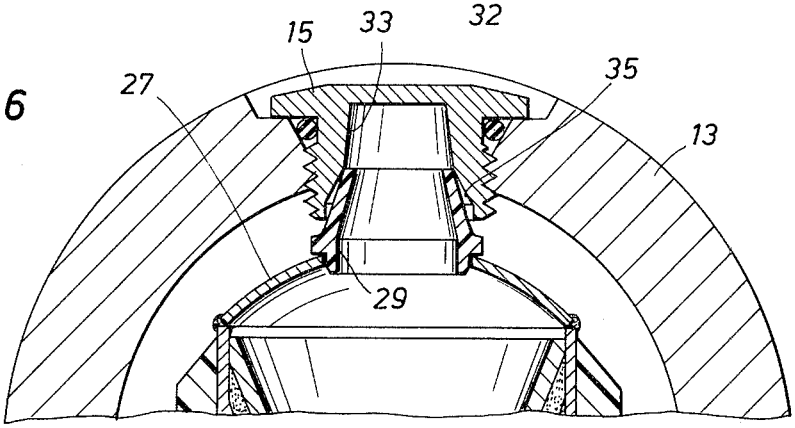

FIGS. 3 and 4 are successive views showing the installation of the preferred apparatus illustrated in FIG. 2 into a carrier having a minimum internal diameter; and FIGS. 5 and 6 are successive views similar to FIGS. 3 and 4 but respectively illustrating the assembly of the new and improved apparatus of FIG. 2 into a carrier of a significantly larger diameter.

Figure 1:
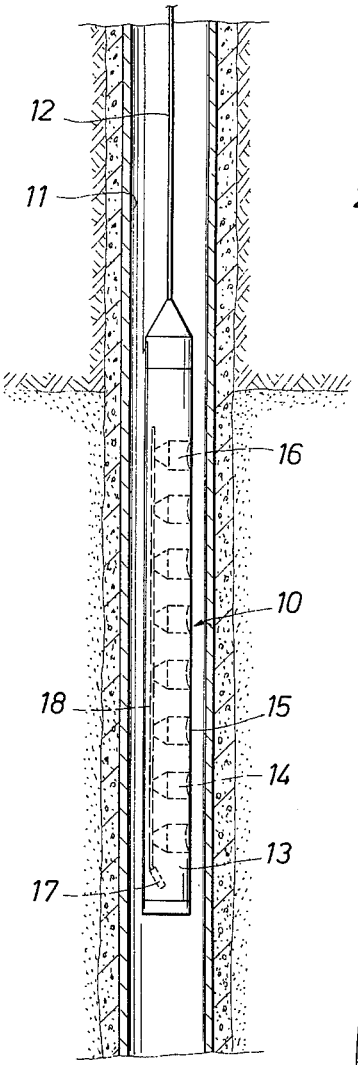
FIG. 1 shows typical perforating apparatus employing the principles of the present invention.

Turning now to FIG. 1, new and improved perforating apparatus 10 incorporating the principles of the present invention is depicted as it will appear when suspended in a well bore 11 by a typical electrical cable 12. As illustrated, the perforating apparatus 10 includes an elongated tubular body or carrier 13 having a plurality of longitudinally-spaced side openings or ports 14 which are respectively fluidly sealed and closed by a port-closure member such as an expendable threaded plug 15. The perforating apparatus 10 further includes perforating means which, in the preferred embodiment of the present invention, are comprised of a plurality of laterally-directed shaped explosive charges 16 disposed at longitudinally-spaced intervals in the carrier 13 and, as will subsequently be explained, are secured therein respectively facing the lateral ports 14. As is typical, the perforating means further include selectively-operable detonating means such as an electrically-responsive blasting cap 17 operatively coupled to a length of detonating cord 18 that is mounted in detonating proximity of each of the shaped charges 16.

As best seen in FIG. 2, in the preferred embodiment of the shaped charges 16, a typical shaped charge liner 19 is operatively disposed in the hollowed forward end of an explosive pellet 20 and adapted for producing, upon detonation, a perforating jet which is directed along a selected perforating axis 21 toward the right as viewed in the drawings. The shaped charge 16 further includes a cylindrical container which in the illustrated preferred embodiment is comprised of a metallic inner jacket 22 and an outer case 23 of a suitable plastic material for minimizing the effects of laterally-directed explosive forces on the interior walls of the carrier 13. The rear of the outer case 23 is reduced as illustrated to provide a rearwardly-projecting axially-aligned boss 24 having a transverse slot or opening 25 for retaining the detonating cord 18 within detonating proximity of the explosive pellet 20. Since the outer case 23 must complementally fit the internal configuration of the carrier 13, the forward end of the case is rounded, as at 26, in a plane perpendicular to the plane of the drawings.

To operatively secure the shaped charge 16 in an aligned position within the carrier 13, the preferred embodiment of the present invention includes retaining means, such as a somewhat-hemispherical or dome-shaped rigid alignment member 27 having a central opening 28 formed therein and a short, tubular spacer 29, which are cooperatively arranged to be coaxially positioned along the axis 21 between the case 23 and the closure plug 15. For the sake of convenience in assembling the perforating apparatus 10, it is preferred that the domed retainer member 27 be fixed in position over the forward end of the shaped charge 16. In the preferred manner of accomplishing this, at least a portion of the outer case 23 is arranged to project a sufficient distance ahead of the forward part of the inner jacket 22 to provide a shallow recess for receiving the peripheral edge of the domed retainer 27. If desired, the retainer 27 can be tightly secured in this position either by a press-fit or by a suitable adhesive, as at 30, so as to facilitate its admission into the carrier 13 as the perforator 10 is being assembled.

Turning now to FIG. 3, the shaped charge 16 is depicted as it will appear when it is disposed in facing alignment with one of the ports 14 in the carrier 13 and the port plug 15 is first being threaded into the port. Although the several charges 16 can be separately installed into the carrier 13, it is preferred to employ a common support or a unitary charge-mounting tube 31 which, as described in U.S. Pat. No. 3,773,119, is uniquely arranged for simultaneously positioning each charge opposite its associated port as at 14. The use of the charge-mounting tube 31 will, of course, facilitate the assembly of the perforator 10 since it will be necessary only to respectively insert the tubular spacers 29 through their associated ports 14; and, once the spacers are positioned on their respective domed retainer members 27, the port plugs 15 can be successively installed and tightened without further ado.

As seen in FIG. 3, it will be appreciated that when each shaped charge 16 is positioned in facing alignment with its associated port 14, the rearward boss 24 on the outer case 23 will be located immediately adjacent to a complementary shallow recess, as at 32, which is formed in the opposite wall of the carrier 13. Thus, as illustrated, as the port plug 15 is tightened the boss 24 is firmly secured in the internal recess 32 as a further aid in assuring that the shaped charge 16 remains in accurate alignment with the port 14.

It will be noted from FIG. 3 that the port plug 15 is hollowed, as at 33, so as to leave the usual thin web 34 which is necessarily of sufficient thickness to withstand the expected well bore pressure but still present only a minimum impairment to the successful operation of the shaped charge 16. However, in keeping with the objects of the present invention, in the preferred embodiment of the invention the rearward portion of the recess 33 is shaped for defining a forwardly-converging frusto-conical wall portion 35 which is adapted to cooperatively engage the forward end of the tubular spacer 29 before the port plug 15 is fully tightened. As depicted at 36, it is preferred that the entrance to the recess 32 be sufficiently enlarged or counterbored to allow at least the first threads 37 on the port plug 15 to always establish minimum threaded engagement before the forward end of the spacer 29 contacts the converging wall portion 35.

Accordingly, as will be realized by a comparison of FIGS. 3 and 4, as the port plug 15 is being tightened, the forward end of the tubular spacer 29 will be progressively compressed inwardly. Thus, by the time the port plug 15 is fully seated, the forward portion of the yieldable spacer 29 will have been substantially deformed into the shape shown in FIG. 4. It will, therefore, be recognized that in keeping with the objects of the present invention, the net result of the depicted inward deformation of the spacer tube 29 will be that a rearward axially-oriented biasing force of moderate magnitude will be imposed on the annular retainer 27, with this force being limited to only what is required for reliably retaining the shaped charge 16 in its operating position and cause little or no deformation of the domed retainer regardless of when the nose of the spacer tube is engaged by the port plug 15.

It will be appreciated, of course, that there are many design parameters affecting the magnitude of the force holding the charges 16 in position. Thus, such factors as the material used for the tubular retainers 29, their wall thickness, overall length and the degree of interference or press fit will all be involved in determining the biasing force. Such determinations are, of course, well within the scope of the usual experience of those skilled in the art. As a result, it is believed necessary only to say that the limited rearwardly-directed biasing action is best achieved by moderately tapering the forward portion of the tubular retainers 29 to preferably be less tapered with the converging walls 35 of the recesses 32 and slightly larger so as to assure the development of a moderate biasing force as the nose of each tubular retainer is yieldably compressed laterally inwardly between its associated port plug 15 and domed retainer 27.

It should be realized, moreover, that although the tubular retainers 29 are cooperatively arranged for yielding laterally as required to develop the necessary biasing action, the sleeves nevertheless must be of sufficient strength to secure the shaped charges 16 against sidewise movement under severe impacts. This is best accomplished by forming the tubular retainers 29 of Nylon or some similar yieldable plastic material having a high impact resistance. Thus, where such a material is used, it has been found best to make the taper on the noses of the spacer sleeves 29 to be only very gradual such as in the order of 10°. To further limit the rearward biasing force, it is preferred to also taper the internal bore of each tubular retainer, as at 38, for facilitating the inward or lateral deformation of the forward ends or noses of the retainers 29. It must be realized also that the spacer tubes 29 are relatively short and, therefore, are comparatively stiff in an axial direction. This axial stiffness will prevent severe impacts from dislodging the shaped charges 16. Since the rearward biasing force is relatively limited, it will be seen, therefore, that the domed alignment or retainer members 27 can be conveniently formed of thin metal, such as aluminum, as a matter of economy.

As previously discussed, the usual practice is to reuse a perforating carrier, as at 13, as many times as it can be safely used without risking its rupture. Thus, it is customary to establish a selected maximum-allowable diameter which experience and testing shows will still be safe. Ordinarily, these maximum-allowable expansions are in the order of no more than about 5% of the original outer diameter of the carrier as at 13.

Accordingly, as illustrated in FIG. 5, the carrier 13 is depicted as it will appear after numerous operations and a new shaped charge 16 has been installed. By comparison with FIG. 3, it will be seen that the carrier 13 has been swelled so much that the new port plug 15 must be rotated several turns before the forward end of the new tubular retainer 29 will engage the tapered recess wall 35. However, it will be appreciated from FIG. 6 that despite the swelling of the carrier 13, the converging bore 35 in the port plug 15 will still be effective for cooperatively compressing the forward portion of the tubular retainer 29 inwardly as it enters the converging bore to still develop a sufficient biasing force for effectively securing the shaped charge 16 within the now-swollen carrier 13. A comparison of FIGS. 4 and 6 will show that, in either case, the force fit or press fit required to telescopically dispose the forward end of a yieldable retainer 29 within its associated port plug 15 will be sufficient for assuring that the boss 24 will remain in its associated recess 32. Since the forward end of each tubular retainer is tapered very gradually, the rearward or axial component of the resulting biasing force will be very moderate so that neither the tubular spacer 29 nor the domed retainer 27 will be axially shortened or deflected by any significant amount regardless of how much the forward end of the spacer is compressed inwardly as the port plug 15 is tightened and the nose of the retainer telescopes into the recess 32.

As a further aspect of the present invention, it should be realized that since the spacer tube 29 and the domed retainer 27 are relatively stiff in an axial direction, it is highly unlikely that even a major impact could dislodge the shaped charge 16 unless the spacer was transversely sheared. In other words, the two retainer members 27 and 29 are specifically intended to be so stiff that they will not deflect axially a sufficient distance to allow the charge 16 to become disoriented; and the tubular spacer is preferably formed of a relatively-strong material that will withstand severe shearing stresses.

Accordingly, it will be recognized that the present invention has provided new and improved perforating apparatus in which one or more shaped charges can be firmly secured in an end-loaded carrier and accurately positioned in coincidental alignment with their respective lateral ports regardless of the size of the carrier. Moreover, by virtue of this new and improved apparatus, undue interference with the perforating jet is eliminated.

While a particular embodiment of the present invention has been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. Perforating apparatus comprising:

a hollow carrier having a threaded port in a wall thereof providing access to the interior of said carrier;

perforating means including a shaped explosive charge in said carrier and facing said port; and means retaining said shaped charge within said carrier in coincidental alignment with said port and including a charge-alignment member engaged with said shaped charge and having a central portion with an opening disposed over the forward end of said shaped charge in coincidental alignment therewith, a port-closure member cooperatively arranged for threaded reception within said port and having a rearwardly-opening recess defining a forwardly-converging tapered wall, and a tubular charge-retainer member having a base portion cooperatively engaged with said charge-alignment member in coincidental alignment with said opening therein and a yieldable nose portion cooperatively sized and arranged to be telescopically received in said recess and deformed inwardly by said tapered recess wall as said port-closure member is threaded into said port for imposing an axially-directed biasing force against said shaped charge before said port-closure member is fully tightened in said port.

2. The perforating apparatus of claim 1 wherein said biasing force is substantially less than the force required to axially deform said charge-alignment member.

3. The perforating apparatus of claim 1 wherein at least said nose portion of said charge-retainer member is formed of a yieldable plastic material and said charge-alignment member is formed of a relatively-rigid metal.

4. The perforating apparatus of claim 1 wherein said charge-retainer member is formed of a yieldable plastic material and said charge-alignment member is formed of a relatively-rigid metal.

5. Perforating apparatus comprising:

a hollow carrier having a threaded port in a wall thereof providing access to the interior of said carrier;

perforating means in said carrier and including a forwardly-opening container, and a shaped charge explosive charge disposed in said container and facing said port; and means retaining said shaped charge within said carrier in coincidental alignment with said port and including an annular charge-alignment member having its peripheral edge portions abuttingly engaged with said container and a forwardly-projecting domed central portion with an opening therein disposed over the forward end of said shaped charge and in coincidental alignment therewith, a port-closure member cooperatively arranged for threaded reception within said port and having a rearwardly-opening axial recess defining a forwardly-converging tapered wall, and a tubular charge-retainer member having an enlarged base portion cooperatively engaged with said charge-alignment member in coincidental alignment with said opening therein and a yieldable nose portion cooperatively sized and arranged to be telescopically received in said recess and progressively collapsed inwardly by said tapered recess wall as said port-closure member is correspondingly threaded into said port for imposing an axially-directed biasing force against said charge-alignment member and said container before said port-closure member is fully tightened in said port.

6. The perforating apparatus of claim 5 wherein said tapered recess wall and the forward end of said nose portion are axially positioned in relation to one another for remaining apart until said port-closure member is partially threadedly engaged within said port.

7. The perforating apparatus of claim 5 wherein said charge-alignment member is formed of metal and is sized and arranged to substantially withstand axial deflection from said biasing force.

8. The perforating apparatus of claim 5 wherein said charge-retainer member is formed of a yieldable plastic material having a high impact resistance and said nose portion thereof has a progressively-reduced wall thickness for promoting its inward collapse as said port-closure member is threaded into said port.

9. The perforating apparatus of claim 8 wherein said charge-alignment member is formed of metal and is sized and arranged to substantially withstand axial deflection from said biasing force.

10. Perforating apparatus comprising:

a hollow carrier having a threaded port in one wall thereof providing access to the interior of said carrier and an internal recess in the opposite wall of said carrier facing said threaded port;

perforating means in said carrier and including a forwardly-opening, transversely-oriented charge container facing said port and a shaped explosive charge disposed in said container; and means retaining said shaped charge within said carrier in coincidental alignment with said port and including a rigid, annular charge-alignment member of metal having its edge portions abuttingly engaged with said shaped charge container and having a forwardly-projecting domed portion with an opening therein disposed over the forward end of said shaped charge and in coincidental alignment therewith, a rearwardly-projecting boss on said container and sized for reception within said internal wall recess, a port-closure member cooperatively arranged for threaded reception within said port and having a rearwardly-opening axial recess defining a forwardly-converging tapered wall, and a tubular charge-retainer member formed of an impact-resistant yieldable plastic and having an enlarged and stiffened base portion cooperatively fitted within said opening in said domed portion of said charge-alignment member and a reduced and tapered nose portion cooperatively sized and arranged to be telescopically received in said axial recess and progressively deformed inwardly by said tapered recess wall as said port-closure member is progressively threaded into said port for imposing an axially-directed biasing force against said charge container without causing significant axial deflection of said charge-alignment member.

11. The perforating apparatus of claim 10 wherein said tapered recess wall and the forward end of said nose portion are axially positioned in relation to one another for remaining apart until said port-closure member is partially threadedly engaged within said port.

12. The perforating apparatus of claim 10 wherein said nose portion of said charge-retainer member has a progressively-reduced wall thickness for promoting its inward collapse as said port-closure member is threaded into said port.

* * * * *